US008558530B2

(12) United States Patent
Pulijala et al.

(10) Patent No.: US 8,558,530 B2
(45) Date of Patent: Oct. 15, 2013

(54) LOW POWER REGULATOR

(75) Inventors: Srinivas K. Pulijala, Tucson, AZ (US); Scott C. McLeod, Oro Valley, AZ (US)

(73) Assignee: SMSC Holdings S.A.R.L., Luxembourg (LU)

( * ) Notice: Subject to any disclaimer, the term of this patent is extended or adjusted under 35 U.S.C. 154(b) by 327 days.

(21) Appl. No.: 13/110,317

(22) Filed: May 18, 2011

(65) Prior Publication Data

US 2011/0291625 A1 Dec. 1, 2011

Related U.S. Application Data

(60) Provisional application No. 61/348,587, filed on May 26, 2010.

(51) Int. Cl.
*G05F 3/16* (2006.01)

(52) U.S. Cl.
USPC ..... 323/314; 327/513

(58) Field of Classification Search
USPC ..... 323/272–274, 280–299, 312–316, 906; 327/108, 112, 170, 292, 513, 538, 540
See application file for complete search history.

(56) References Cited

U.S. PATENT DOCUMENTS 3,671,770 A * 6/1972 Frederiksen ..... 327/513
4,447,784 A * 5/1984 Dobkin ..... 323/226
5,105,102 A 4/1992 Shioda
5,506,496 A 4/1996 Wrathall et al.
5,539,603 A 7/1996 Bingham
5,559,425 A 9/1996 Allman
5,642,033 A 6/1997 Bartol et al.
5,694,031 A 12/1997 Stanojevic
5,739,681 A * 4/1998 Allman ..... 323/314
6,057,721 A * 5/2000 Nolan et al. ..... 327/143
6,184,667 B1 2/2001 Lacey
6,188,212 B1 2/2001 Larson et al.
6,201,375 B1 3/2001 Larson et al.
6,208,123 B1 3/2001 Sudo
6,265,856 B1 7/2001 Cali' et al.
6,300,749 B1 10/2001 Castelli et al.
6,507,174 B1 1/2003 Qian
6,614,280 B1 9/2003 Panwitz
6,759,835 B2 7/2004 Turvey et al.

(Continued)

OTHER PUBLICATIONS

Op-Amp Based Linear Regulators, tangentsoft.net/elec/opamp-linreg.html, 10 pages. (Retrieved May 4, 2011).

*Primary Examiner* — Rajnikant Patel
(74) *Attorney, Agent, or Firm* — King & Spalding L.L.P.

(57) ABSTRACT

A voltage regulator may derive current from a bias circuitry having a constant-transconductance. The bias circuitry may generate the bias current using three NMOS devices. The temperature coefficient of the bias current may be within a specified, desired range. The bias current may be mirrored to low-power regulator circuitry to bias a diode-connected transistor in the low-power regulator circuitry to operate in the strong inversion region. A ratioed current based on the output load current may be injected into a bipolar junction transistor (BJT) device to cause the gate-source voltage ($V_{GS}$) of the diode-connected device to track the $V_{GS}$ of the output transistor of the voltage regulator, to ensure tighter load regulation. By operating the diode-connected transistor in strong inversion, by maintaining its ($V_{GS}$) constant over temperature, and by cancelling the $V_{GS}$ of the output transistor of the voltage regulator with the base-emitter voltage ($V_{BE}$) of the BJT device, the regulated voltage output may become free of the effects of temperature and supply voltage.

21 Claims, 3 Drawing Sheets

(56) References Cited

U.S. PATENT DOCUMENTS 6,861,831 B2 3/2005 Ngiap Ho
7,030,598 B1 4/2006 Dow
7,486,129 B2 * 2/2009 Pietri et al. ..... 327/539
2004/0212429 A1 10/2004 Gupta et al.

* cited by examiner

LOW POWER REGULATOR

PRIORITY CLAIM

The present application claims benefit of priority to provisional application No. 61/348,587 titled "Low Power Regulator" filed on May 26, 2010, whose inventors are Srinivas K. Pulijala and Scott C. McLeod, and which is hereby incorporated by reference in its entirety, as though fully and completely set forth herein.

BACKGROUND OF THE INVENTION

1. Field of the Invention

This invention relates generally to the field of integrated circuit design and, more particularly, to the design of voltage regulator circuits.

2. Description of the Related Art

Voltage regulators are electrical regulators generally designed to automatically maintain constant voltage levels, and may operate according to electromechanical principles, or by using passive/active electronic components. In some designs, voltage regulators may be used to regulate one or more AC and/or DC voltages, performing the voltage regulation by comparing an actual output voltage to some internal fixed reference voltage. The difference between the voltages is typically amplified and used as a control signal into a control circuit configured to maintain a substantially constant output voltage, essentially forming a negative feedback control loop. If the output voltage is too low, the control circuit operates to generate a higher voltage. If the output voltage is too high, the control circuit operates to generate a lower voltage. This allows the output voltage to remain essentially constant. In most cases the control loop is carefully designed in order to obtain the desired tradeoff between response speed and stability.

Voltage regulators are often used with digital blocks that enter a low power (sleep) mode, sometimes called a "deep sleep" mode. When a voltage regulator is used in conjunction with a digital block that enters a low power mode, the voltage regulator still generally requires a quiescent current to power the digital block during the sleep mode. Also, a voltage regulator generally has a variation in regulated output voltage, as well as an over supply voltage variation, a corner variation and temperature variation. It is generally desirable for the regulator to deliver an appropriate amount of current when the integrated circuit (IC), which is powered by the voltage regulator, exits a sleep mode to enter a normal mode of operation.

FIG. 1 illustrates one prior art voltage regulator. As shown in FIG. 1, the voltage regulator uses a large resistor divider composed of resistors R1 and R2, coupled to an output stage that consists of a source follower circuit composed of an NMOS device NM0, and an impedance coupled between the output node (providing the regulated output voltage $Vdd_{reg}$ and Vss. When constructed on an IC, the voltage regulator in FIG. 1 will typically require a large die size, as the resistor network has to be sufficiently large for the circuit to draw less quiescent current. The circuit shown in FIG. 1 is therefore undesirable, since it uses a large resistor divider network that consumes a substantial area of the chip for reduced quiescent current. Finally, it would be difficult for the source follower circuit to deliver the current to the digital block when the IC returns from deep sleep mode to a normal mode of operation before the voltage regulator (which powers the entire IC) turns on.

FIG. 2 illustrates another prior art voltage regulator. As shown in FIG. 2, an operational amplifier is used as an error amplifier for driving the pass transistor PM0 based on a band gap voltage Vbg and the output of a resistor divider constructed from resistors R1 and R2, which also provides the voltage input to the inverting input of the error amplifier. The bandgap voltage is provided at the non-inverting input of the amplifier, with the pass transistor in this case being a PMOS device. This type of approach represents the traditional way of powering digital/analog blocks in an integrated circuit whenever the external supply to the chip is different from the supply required for powering the digital/analog components. The voltage regulator shown in FIG. 2 is undesirable because it requires a large area, and requires the load/internal capacitor to be stable over the entire range of $I_L/C_L$ (load current over load capacitance) conditions.

Other corresponding issues related to the prior art will become apparent to one skilled in the art after comparing such prior art with the present invention as described herein.

SUMMARY OF THE INVENTION

One embodiment of the present invention comprises an improved voltage regulator. The voltage regulator may sink less quiescent current (e.g. less than 1.5 μA) to power a digital block during a deep sleep mode. Furthermore, the regulated output voltage provided by the voltage regulator may experience changes of less than 400 mV (e.g. variation between 1.6V and 2V) over supply voltage variation (i.e. +/−10%), corner variation and temperature variation. In addition, the voltage regulator may be able to deliver current of 300 μA when the device powered by the voltage regulator, e.g. and integrated circuit (IC) exits a deep sleep mode to enter a normal mode of operation.

In one set of embodiments, a voltage regulator may derive current from a constant-gm (constant transconductance) bias circuitry, which may include three NMOS devices to generate the bias current. The temperature coefficient (TC) of this generated current may be within a specified, desired range, e.g. about −1000 ppm/C. In general, the generated bias current may be an NTAT (negative to absolute temperature, i.e. inversely proportional to absolute temperature) current with a specified TC value. The bias current may then be mirrored to low-power regulator circuitry, which may include a diode-connected transistor device (e.g. a diode-connected NMOS device). More specifically, the mirrored NTAT current generated from the constant-gm bias circuit may be used to bias the diode-connected transistor device, with the specified NTAT characteristic of the biasing current ensuring that the gate-source voltage ($V_{GS}$) of the diode-connected transistor device does not vary with changes in temperature. In addition, a ratioed current based on the output load current may be injected—fed back—into a bipolar junction transistor (BJT) device coupled to the diode-connected transistor device, to have the diode-connected transistor device operate in the strong inversion region. Providing this ratioed feedback current to the BJT device causes the $V_{GS}$ of the diode-connected transistor device to track the $V_{GS}$ of the output transistor device, which provides tighter load regulation. Therefore, by operating the diode-connected transistor device in strong inversion, by maintaining its $V_{GS}$ constant with respect to changes in temperature, and by cancelling the $V_{GS}$ of the output transistor of the voltage regulator with the base-emitter voltage ($V_{BE}$) of the BJT device, the regulator output $Vdd_{reg}$ may become free of the effects of temperature and supply voltage.

Thus, various embodiments of the invention may provide an improved voltage regulator.

BRIEF DESCRIPTION OF THE DRAWINGS

The foregoing, as well as other objects, features, and advantages of this invention may be more completely understood by reference to the following detailed description when read together with the accompanying drawings in which.

Figure 1:
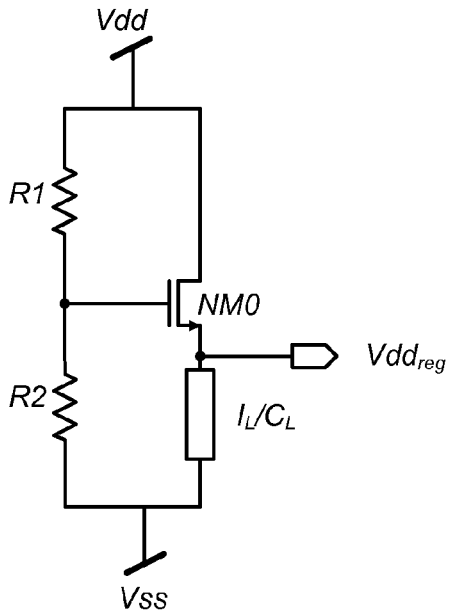
FIG. 1 (Prior Art)
FIG. 1 shows one embodiment of a prior art voltage regulator circuit.
Figure 2:
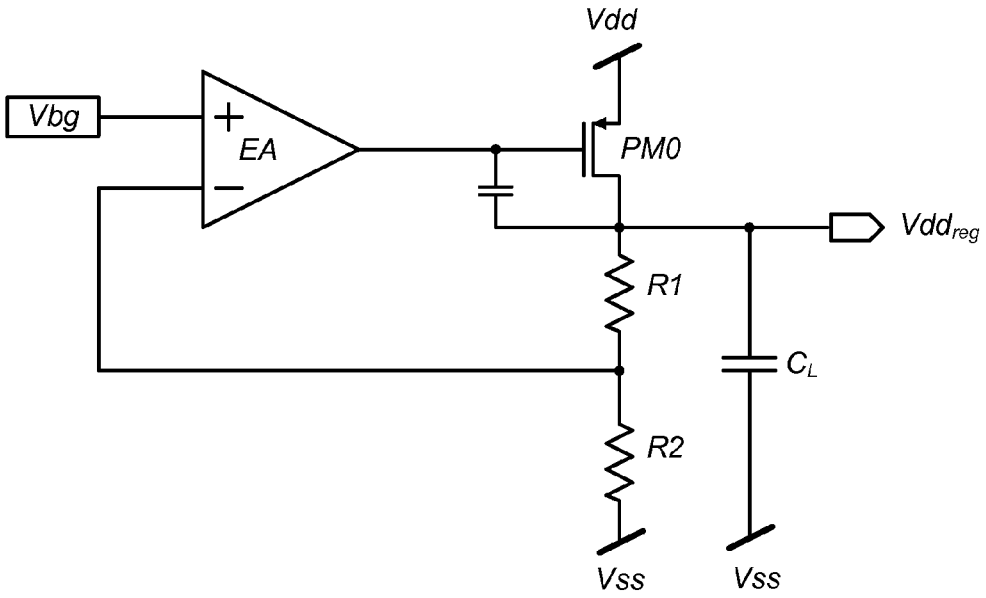
FIG. 2 (Prior Art)
FIG. 2 shows another embodiment of a prior art voltage regulator circuit.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents, and alternatives falling within the spirit and scope of the present invention as defined by the appended claims. Note, the headings are for organizational purposes only and are not meant to be used to limit or interpret the description or claims. Furthermore, note that the word "may" is used throughout this application in a permissive sense (i.e., having the potential to, being able to), not a mandatory sense (i.e., must)." The term "include", and derivations thereof, mean "including, but not limited to". The term "coupled" means "directly or indirectly connected".

DETAILED DESCRIPTION OF THE PREFERRED EMBODIMENTS

Figure 4:
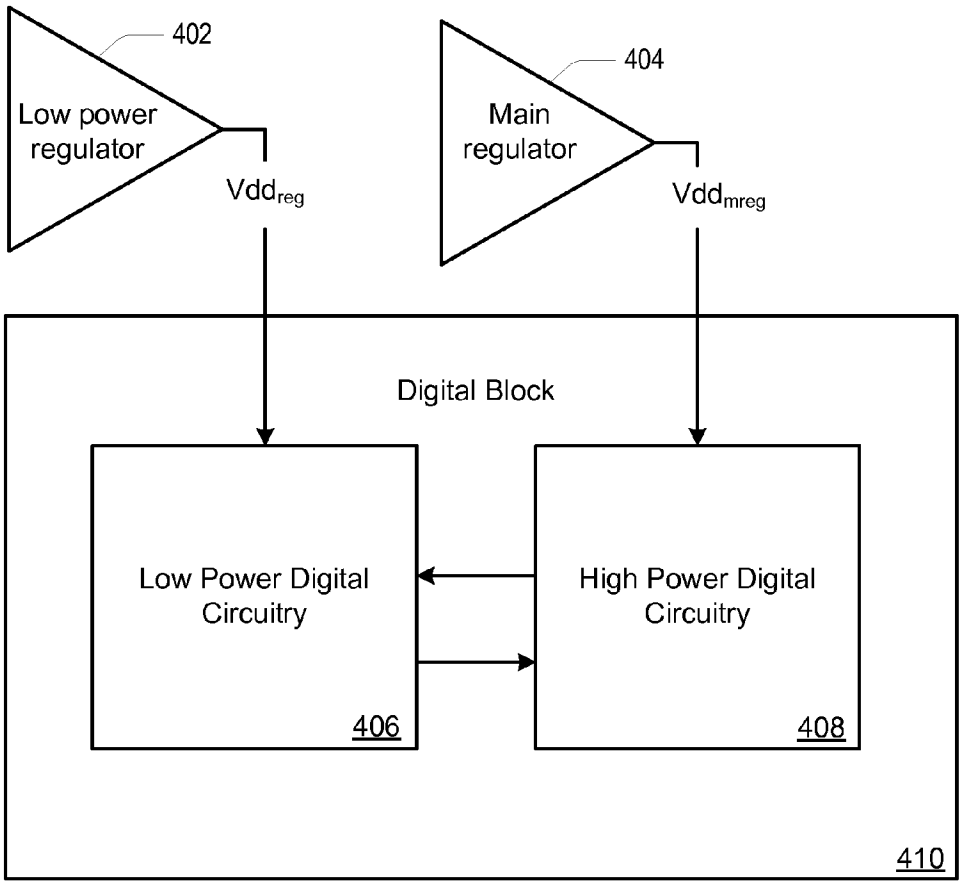
FIG. 4 shows a block diagram of a system that includes a voltage regulator such as the one shown in FIG. 3.

FIG. 4 shows one embodiment of a system that includes multiple voltage regulators, including a voltage regulator intended to provide power to low power digital circuitry. As shown in FIG. 4, a digital block 410 may include low power digital circuitry 406 and high power digital circuitry 408, which may be powered by a low power regulator 402 and a main power regulator 404, respectively. It should be noted that in a variety of embodiments, the high power and low power portions of digital block 410 may not actually be implemented as separate and distinct blocks, and that distinct circuitry blocks 406 and 408 are shown for ease of understanding. Specifically, the diagram is meant to illustrate the different voltage regulators employed to respectively power the high power and low power circuits. Thus, digital block 410 may enter a low power mode, or sleep mode, during which some or all of the low power digital circuitry 406 may still require power, while some or all portions of high power digital circuitry 408 may be powered down. Accordingly, voltage regulator 402 may require a quiescent current to power low power digital circuitry 406 during the sleep mode. It is desirable for regulator 402 to deliver an appropriate amount of current when low power circuitry 406 within digital block 410 (which may be an integrated circuit, or IC) exits sleep mode to enter a normal mode of operation.

Figure 3:
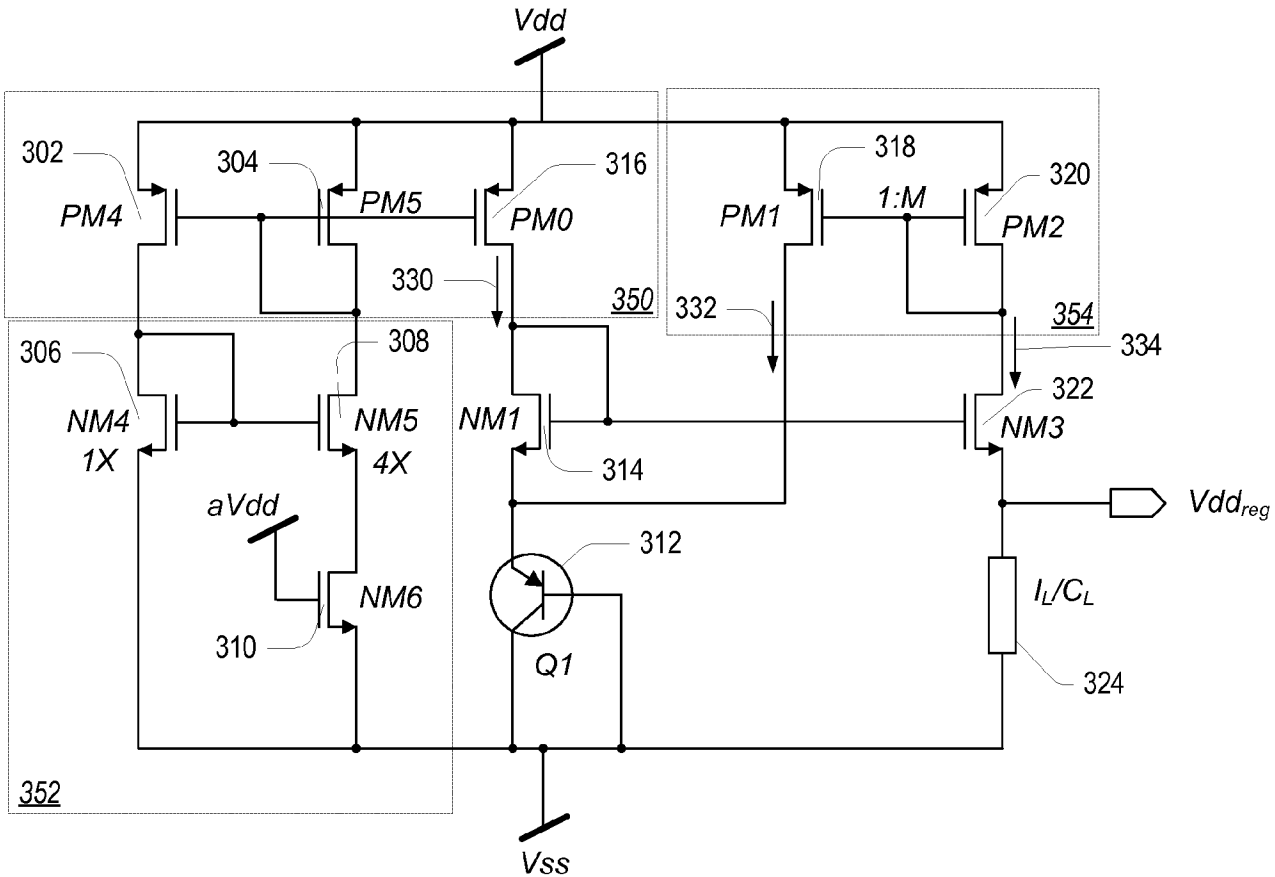
FIG. 3 shows a voltage regulator according to one embodiment of the invention.

FIG. 3 shows one embodiment of a voltage regulator circuit, which may be operated as voltage regulator 402, that produces a regulated output voltage $Vdd_{reg}$ that is free from the effects of variations in temperature and supply voltage (Vdd). The voltage regulator may derive current from a constant-gm (constant transconductance) bias circuitry, which may include three NMOS devices 306, 308, and 310 to generate the bias current flowing through the respective channels of NMOS devices 308 and 310. The temperature coefficient (TC) of the bias current may be within a specified, desired range, e.g. about −1000 ppm/C. In one set of embodiments, the generated bias current may generally be an NTAT (negative to absolute temperature, i.e. inversely proportional to absolute temperature) current having a specified TC value. The bias current may then be mirrored (mirrored bias current 330) to a low-power regulator circuitry portion of the voltage regulator that includes diode-connected transistor 314. Specifically, mirrored current 330 may be used to bias diode-connected NMOS device 314, with the specified NTAT characteristic of biasing current 330 ensuring that the gate-source voltage ($V_{GS}$) of NMOS device 314 remains constant with respect to changes in temperature.

In addition, a ratioed current 332 may be provided to BJT device 312, which has its emitter terminal series connected to the source terminal of NMOS device 314. Current 332 may be generated through current mirror 354, by mirroring 1/M of current 334 to flow in the channel of PMOS device 318 to be injected into the emitter of bipolar junction transistor (BJT) device 312. It should be noted that BJT device is a PNP device, or more generally, a PN junction device. Alternate embodiments may include equivalent circuits that employ another PN junction device, e.g. an NPN device. In addition, those skilled in the art will also appreciate the complementary nature of MOS devices, which allow for various embodiments to be implemented with PMOS devices in lieu of NMOS devices, and vice-versa, with the appropriate interconnections and connections to supply voltages and voltage references (e.g. ground) determined by the functionality of the circuit disclosed herein.

A ratioed value of current 334, which is in effect the output current of the voltage regulator, may be injected into the emitter of BJT device 312, to have the $V_{GS}$ of diode-connected NMOS device 314 track the $V_{GS}$ of output NMOS device 322, providing tighter output voltage regulation. By operating diode-connected transistor device 314 in the strong inversion region, by maintaining its gate-source voltage ($V_{GS}$) constant over temperature, and by cancelling the $V_{GS}$ of output transistor 322 of the voltage regulator with the base-emitter voltage ($V_{BE}$) of BJT device 312, the regulator output $Vdd_{reg}$ may become free of the effects of temperature and supply voltage. In other words, the output voltage $Vdd_{reg}$ may become free of the effects of variations in temperature and variations in supply voltage (Vdd).

As mentioned above, the voltage regulator may include a bias current generator 352 that includes NMOS devices 306, 308, and 310. NMOS device 310 may be operated in the ohmic region, with its gate tied to supply voltage a Vdd. Bias generator circuit 352 may therefore base the bias current off ground (Vss), using NMOS devices 306, 308, and 310. The bias current generator circuit 352 may generate an NTAT current having a specified temperature coefficient, flowing through the channel of NMOS device 308. This NTAT current may be mirrored through mirroring circuit 350, producing biasing current 330 for the purpose of biasing diode-connected NMOS device 314. Since biasing current 330 is a mirrored version of the current generated by bias current generating circuit 352, it is also an NTAT current having the specified TC, which ensures that the gate-source voltage of NMOS device 314 remains constant with respect to changes in temperature. The reason the bias current may be generated with a slightly negative TC is to have a lower regulated output voltage $Vdd_{reg}$ at higher (hot) temperatures, in order to counter possible leakage associated with the digital block which may be powered by the voltage regulator while in deep sleep mode.

The operating principles described above may be more formally examined as follows. For a respective gate-source voltage ($V_{GS}$) value, the drain current of a MOSFET device is independent of temperature. Referring to FIG. 3, assuming that NMOS device 314 (transistor NM1) is saturated (i.e. is operating in strong inversion), and that:

$$\mu = \mu_0\left(\frac{T}{T_0}\right)^{-1.5} \tag{1}$$

where μ is carrier mobility at temperature T, and $\mu_0$ is carrier mobility at temperature $T_0$, the threshold voltage may be expressed by:

$$V_{THN}(T)=V_{THN}(T_0)+\alpha(T-T_0), \tag{2}$$

where 'α' is the temperature coefficient of $V_{THN}$. In one set of embodiments, a may have a value of −0.0023V/° C., and T may have a value of 27° C. The drain current flowing through transistor device 314 (NM1) may be expressed by:

$$I_D(T) = \frac{\mu_0 C_{OX} W}{2L}\left(\frac{T}{T_0}\right)^{-1.5}(V_{GS} - V_{THN}(T_0) - \alpha(T - T_0))^2 \tag{3}$$

where 'W' is channel width and 'L' is channel length, $I_D$ is the channel current. From equation 3, $$\frac{dI_D(T)}{dT} = \frac{-1.5\mu_0 C_{OX}}{2T_0}\left(\frac{T}{T_0}\right)^{-2.5}(V_{GS} - V_{THN}(T_0) - \alpha(T - T_0))^2 + \alpha\mu_0 C_{OX}\left(\frac{T}{T_0}\right)^{-1.5}(V_{GS} - V_{THN}(T_0) - \alpha(T - T_0)) \tag{4}$$

Therefore, $$V_{GS} - V_{THN}(T_0) - \alpha(T - T_0) = \frac{-4T\alpha}{3} \tag{5}$$

and $$V_{GS(ZTC)} = V_{THN}(T_0) - \alpha(T_0) - \frac{T\alpha}{3}, \tag{6}$$

which represents the $V_{GS}$ value of NMOS device 314 (NM1) for which the regulator output may be held close to Zero TC (ZTC). In one set of embodiments, for example at T=27° C. (300° K), $V_{GS(ZTC)}$ has a value of 2.079V. The regulated output voltage $Vdd_{reg}$ may be expressed by:

$$Vdd_{reg}=V_{BEQ1}+V_{GSNM1}-V_{GSNM3} \tag{7}$$

where $V_{BEQ1}$ is the base-emitter voltage of BJT device 312, $V_{GSNM1}$ is the gate-source voltage of diode-connected NMOS device 314 (NM1), and $V_{GSNM3}$ is the gate-source voltage of the voltage regulator output NMOS device 322 (NM3). It follows that for a temperature value of 27° C., $$Vdd_{reg}=0.676V+2.069V-0.979V=1.766V. \tag{8}$$

At a temperature of −40° C., $$Vdd_{reg}=0.812V+2.079V-1.076V=1.815V. \tag{9}$$

At a temperature of 125° C., $$Vdd_{reg}=0.474V+2.059V-0.835V=1.7V. \tag{10}$$

By mirroring a portion of the current from PMOS device 320 (PM2) into BJT device 312 (Q1—more generally a PNP device), NMOS device 314 may be maintained in the strong inversion region with an increasing current load. With the increasing current load, as long as NMOS device 322 is operating in the weak inversion region, the effects of temperature fluctuations on BJT device 312 and NMOS device 322 may be cancelled to a first order, to maintain a tight range of the regulated output voltage $Vdd_{reg}$ over all corners, temperature variation, and supply variation. This is well illustrated for example values provided above in equations 8, 9, and 10.

Various embodiments of the voltage regulator disclosed herein thus provide various advantages, such as low quiescent current, less die area, and no stability issues due to the absence of a high impedance node. In addition, no Miller capacitances are required to stabilize the regulator. Various embodiments of the voltage regulator circuit may also be used in applications where the regulator needs to deliver a few hundred μAs. Furthermore, the regulated output voltage provided by the voltage regulator may undergo less variation across the corners, since the bias current is based solely on transistor devices of a single type, e.g. on NMOS devices as opposed to a combination of transistor devices of different types, e.g. on PMOS and NMOS devices. Finally, the feedback from the output NMOS device 322 to the BJT device 312 ensures tighter range of $Vdd_{reg}$ over current load.

Although the embodiments above have been described in considerable detail, other versions are possible. Numerous variations and modifications will become apparent to those skilled in the art once the above disclosure is fully appreciated. It is intended that the following claims be interpreted to embrace all such variations and modifications. Note the section headings used herein are for organizational purposes only and are not meant to limit the description provided herein or the claims attached hereto.

We claim:

1. A voltage regulator comprising:

a diode-connected transistor device biased by a bias current having a specified temperature coefficient to prevent a first voltage developed between a control terminal and a channel terminal of the diode-connected transistor device from changing with respect to temperature;

a PN-junction device coupled to the diode-connected transistor device and configured to receive a feedback current based on an output current effected by the voltage regulator, to enable the diode-connected transistor device to operate in strong inversion region; and an output transistor device coupled to the diode-connected transistor device and having a channel terminal configured to provide a regulated output voltage to effect the output current.

2. The voltage regulator of claim 1, wherein the bias current is an NTAT (negative with respect to absolute temperature) current.

3. The voltage regulator of claim 1, further comprising bias circuitry configured to generate the bias current based off a voltage reference.

4. The voltage regulator of claim 1, further comprising bias circuitry configured to generate the bias current using transistor devices that are all of a same type.

5. The voltage regulator of claim 1, further comprising:

a biasing circuit configured to generate a first current having the specified temperature coefficient; and a mirroring circuit configured to mirror the first current to a first channel terminal of the diode-connected transistor device to effect the bias current flowing into the first channel terminal of the diode-connected transistor device, wherein the bias current is a mirrored version of the first current.

6. The voltage regulator of claim 5, wherein the biasing circuit has a constant transconductance.

7. The voltage regulator of claim 5, wherein the biasing circuit comprises:

a first transistor device configured to operate in the ohmic region, and comprising:

a control terminal coupled to a supply voltage; and a first channel terminal coupled to a voltage reference; and a pair of transistor devices with their respective control terminals connected to each other, wherein a first channel terminal of one of the pair of transistor devices is connected to a second channel terminal of the first transistor device, to effect the first current flowing through a respective channel of the first transistor device and a respective channel of the one of the pair of transistor devices.

8. The voltage regulator of claim 7, wherein the one of the pair of transistor devices has a channel width that is a multiple of the channel width of the other one of the pair of transistor devices.

9. The voltage regulator of claim 1, further comprising a mirroring circuit configured to mirror a fraction of the output current to the PN-junction device, to effect the feedback current flowing into the PN-junction device, wherein the feedback current is a ratioed mirrored version of the output current.

10. The voltage regulator of claim 1, wherein the PN-junction device comprises a first terminal coupled to a channel terminal of the diode-connected transistor device, and configured to receive the feedback current, and further comprises a second terminal and a third terminal both connected to a voltage reference.

11. A method for producing a regulated output voltage, the method comprising:

generating a bias current having a specified temperature coefficient;

biasing a diode-connected transistor device with the bias current, wherein in response to the bias current having the specified temperature coefficient, a first voltage developed between a control terminal and a channel terminal of the diode-connected device remains unaffected by changes in temperature;

injecting a feedback current into a PN-junction device coupled to the diode-connected transistor device to operate the diode-connected transistor device in a strong inversion region, wherein the feedback current is based on an output current effected by the regulated output voltage; and controlling an output transistor with the first voltage to generate the regulated output voltage.

12. The method of claim 11, further comprising:

generating the feedback current by mirroring a fraction of the output current into a first terminal of the PN-junction device, wherein the mirrored fraction of the output current is the feedback current.

13. The method of claim 11, wherein said generating the bias current comprises:

generating a first current having the specified temperature coefficient; and mirroring the first current to a channel terminal of the diode-connected transistor device, wherein the mirrored first current is the bias current.

14. The method of claim 13, wherein said generating the first current comprises generating the first current based on a voltage reference.

15. The method of claim 13, wherein said generating the first current comprises generating the first current using transistor devices that are all of a same type.

16. The method of claim 11, wherein said generating a bias current having a specified temperature coefficient comprises generating a negative to absolute temperature bias current.

17. A voltage regulator comprising:

a diode-connected transistor device configured to operate in a strong inversion region, and further configured to provide a first voltage that remains unaffected by variations in temperature; and an output transistor device configured to be controlled by the first voltage to produce a regulated output voltage that remains unaffected by changes in temperature and supply voltage.

18. The voltage regulator of claim 17, wherein the diode-connected transistor device is configured to be biased by a bias current having a specified temperature coefficient that causes the first voltage to remain unaffected by variations in temperature.

19. The voltage regulator of claim 17, further comprising a PN-junction device coupled to the output transistor device, and configured to receive a feedback current based on an output current effected by the regulated output voltage, to enable the diode-connected transistor device to operate in the strong inversion region.

20. The voltage regulator of claim 19, wherein the feedback current is a mirrored, ratioed version of the output current.

21. The voltage regulator of claim 17, wherein the diode-connected transistor device and the output transistor device are NMOS devices.

* * * * *